US007690229B2

(12) United States Patent
McKee

(10) Patent No.: US 7,690,229 B2
(45) Date of Patent: Apr. 6, 2010

(54) STATION FOR ALTERNATE LOCKS

(75) Inventor: Winston Lee McKee, 639 Skimmer Dr., Patterson, CA (US) 95363

(73) Assignee: Winston Lee McKee, Patterson, CA (US)

( * ) Notice: Subject to any disclaimer, the term of this patent is extended or adjusted under 35 U.S.C. 154(b) by 298 days.

(21) Appl. No.: 11/729,424

(22) Filed: Mar. 27, 2007

(65) Prior Publication Data

US 2008/0041123 A1 Feb. 21, 2008

Related U.S. Application Data

(60) Provisional application No. 60/791,978, filed on Apr. 14, 2006.

(51) Int. Cl.
*E05B 65/06* (2006.01)

(52) U.S. Cl. ..... 70/129; 70/DIG. 63; 292/148

(58) Field of Classification Search ..... 70/129, 70/134, DIG. 63; 292/148, 153; D8/341, D8/339

See application file for complete search history.

(56) References Cited

U.S. PATENT DOCUMENTS 3,889,497 A * 6/1975 Tuttle ..... 70/14
3,906,760 A * 9/1975 Parker, Jr. ..... 70/154
3,988,031 A 10/1976 Meyer
4,085,599 A * 4/1978 Fischer et al. ..... 70/14
4,167,281 A * 9/1979 Spencer ..... 292/216
D267,698 S 1/1983 Domes
D268,478 S 4/1983 Domes
4,697,443 A * 10/1987 Hillin ..... 70/121
4,900,075 A * 2/1990 Smith ..... 292/263
4,997,219 A 3/1991 Carter
5,868,015 A 2/1999 Eaker
6,857,299 B2 2/2005 McNeil
7,000,440 B2 * 2/2006 Martin ..... 70/129
7,503,194 B2 * 3/2009 McNeil ..... 70/2

* cited by examiner

*Primary Examiner*—Suzanne D Barrett
(74) *Attorney, Agent, or Firm*—Quine Intellectual Property Law Group; Gary Baker

(57) ABSTRACT

Locking devices are provided that can be opened by alternate users with different keys. The devices generally include a lock slider anchored to an anchor tab through one or more link sliders. The sliders can be slidably mounted to a slide mount, such as, e.g., a slide shaft or slide slit in a housing. When the anchor tab, link slider and lock slider are all shackled together with, e.g., two or more padlocks, the lock bolt of the lock slider is substantially immobilized with the device in a locked configuration. When one or more of the shackles is removed, the lock slider is free to moved to an unlocked position along the slide mount.

19 Claims, 8 Drawing Sheets

STATION FOR ALTERNATE LOCKS

CROSS-REFERENCE TO RELATED APPLICATIONS

This application claims priority to and benefit of a prior U.S. Provisional Application No. 60/791,978, Station for Alternate Locks, by Winston Lee McKee, filed Apr. 14, 2006. The full disclosure of the prior application is incorporated herein by reference.

FIELD OF THE INVENTION

The present invention relates to gate locking devices. In particular, the invention provides mechanisms that allow separate users of different locks to open the same latch or release a security chain.

BACKGROUND OF THE INVENTION

It is a common situation to have a large number of people or institutions that require access to an area secured with a lock. One solution to this problem of multiple user access is to provide each user with a key to the lock. However, this presents logistic problems in distribution and control of access authorization. With this solution, users that need access to many sites can be required to carry and organize an unmanageable number or keys. In many cases, users prefer to each maintain their own system of locks having the same key (e.g., master key) to access many sites. The default solution to provide multiple lock access to gated areas appears to be by securing the gate with a chain and several padlocks linked to each other in a sequential "daisy chain" loop. However, besides being unsightly, this system often leads to a lock out of other users when one user directly locks the chain leaving the other locks out of the loop. Many other solutions to the multiple lock problem have been offered. However, these solutions are often overly complex in manufacture, require retrofit to existing gates, require organized administration of key distribution, are not applicable to chain lock systems, are prone to intentional or accidental disassembly by users, and/or openly expose the separate locks to attack by intruders.

The Multiple Padlock Latch of McNeil (U.S. Pat. No. 6,857,299) includes a door latch that can be pushed open by any one of a series of pins. The pins can each be secured with a separate padlock. To open the latch, a user removes his padlock from one of the pins, allowing the pin to be pushed in to disengage the latch so the door can be opened. However, this system is somewhat complex, is easily damaged, is not easily installed on existing doors, and does not functionally interact with chains common to many gated fences Sliding bolt latches with multiple locks, such as those of Domes (D267,698), and Eaker (U.S. Pat. No. 5,868,015), have a latch mounting body on a gate with series of sliding link sections mounted to the gate bolt between anchor tabs. A series of padlocks can connect the anchor tabs through the sliding links so that the bolt can not be withdrawn from a receiver, thus preventing the gate from being opened. Removal of any one padlock disconnects the anchor tabs, allowing the bolt to slide from the receiver, so the gate can be opened. Still, these systems can suffer from too open exposure of the locks to intruders, retrofit difficulties, and a lack of ready functional interaction with existing chain systems.

In view of the above, a need remains for a multi-user locking system that is simple yet shielded from attack. It would be desirable to have a multilock system that is compatible with existing chain lock systems and easily retrofitted to common gates. The present invention provides these and other features that will be apparent upon review of the following.

SUMMARY OF THE INVENTION

Locking devices of the invention can be unlocked, e.g., by removing any one of several padlocks, thus allowing access to secured locations by users having different keys. The devices generally include a frame with an anchor tab that can retain a series of link sliders and a lock slider, which are slidably mounted to a slide mount on the frame. When the anchor, links and lock slider are locked together, e.g., with shackles, a lock bolt on the lock slider can held in a locked configuration, e.g., bolting a door shut or securely locking a chain around a gate.

In one preferred embodiment, a housing is used to protect and strengthen the locking device, which is configured to capture a chain link. For example, the locking device can include a slide mount frame with: a housing, a slide shaft, a receiver recess, and an anchor tab with an anchor bore. Link sliders with link tabs having one or more link bores are slidably mounted along the slider shaft. A lock slider, with a lock bolt and a lock tab with a lock bore, is also slidably mounted to the slide shaft. With the anchor bore aligned with a first of the one or more link bores (e.g., holes) of a first slider link, a first shackle can be passed through to lock the frame anchor and first link slider together. With the lock bore aligned with the same or another link bore of the first link slider, a second shackle can be passed through (e.g., inserted into the aligned tab bores) to lock the lock slider and first link slider together. Thus the anchor, link slider and lock slider can be all locked together. In this configuration, a lock bolt extending from the lock slider can be immobilized in a position, e.g., that bars access to a location, e.g., by capturing a chain link and/or by dead bolting a latch. In many embodiments, the lock bolt is received into a receiver recess when the device is in the locked configuration. In many embodiments there are two or more link sliders that can be locked to each other with shackles in turn and to the lock slider, thus locking the lock slider to the anchor tab. In locking devices with two or more link sliders, three or more padlocks can each independently release the lock slider and thus unlock the locking device. When freed by the removal of at least one of the shackles (e.g., padlocks) the lock slider can preferably have a freedom of movement along the slide shaft of at least 0.25 inches, 0.5 inches, 1 inch, 2 inches, or more. This freedom of movement can allow the lock bolt to be moved to an unlocked position on the slide mount.

In some embodiments, the slide mount can be a slit, e.g., in a housing, rather than a slider shaft. For example, a locking device can include a slide mount frame comprising a housing with a slide slit and an anchor tab with an anchor bore. Link sliders with link tabs and link bores can be slidably housed in the housing with the link tabs protruding out from the housing through the slide slit. A lock slider with a lock bolt and a lock tab having a lock bore can also be slidably mounted in the housing with the lock tab protruding out from the housing through the slide slit. The anchor bore can be aligned with a first of the link bores allowing passage of a first shackle into both the anchor bore and the first link bore, thus locking the link slider to the anchor tab. The lock bore can be aligned with another part of the first link bore, or with a second link bore in the link slider, allowing passage of a second shackle into the lock bore and the link bore, thus locking the link slider to the lock slider. With the anchor, link slider and lock slider all locked together, the lock bolt is substantially immobilized in a locked position, e.g., dead bolting a door or capturing a chain link. Again, the addition of more link sliders between the anchor and lock slider can allow locking with additional shackles and independent unlocking by any of three or more users.

In certain preferred embodiments, the slide mount frame includes a housing. The housing can function as part of the frame structure and/or part of the slide mount. In preferred embodiments, the housing comprises has a box or cylinder shape, e.g., like a container having solid walls on all but one side. The housing can be adapted to mount the frame to a door frame, a fence, a door, a gate and/or the like. The open side of the housing can be oriented up, down or horizontally.

In certain embodiments, the locking device includes a chain that is functionally routed, e.g., around gate posts and/or gate frame members, to secure an entry way. In some embodiments, a chain with a first link can be captured by the lock bolt before it is received by the recess and the anchor, link sliders and lock sliders are locked together. In other embodiments the lock bolt can capture two or more links of the same chain (e.g., both ends of a chain) after the chain is routed to secure an entryway. In another embodiment, one end of a chain is mounted (e.g., welded) to the slide mount frame, the chain routed to secure the entryway, and finally a link of the chain is captured by the lock bolt to lock the chain in place.

DEFINITIONS

Unless otherwise defined herein or below in the remainder of the specification, all technical and scientific terms used herein have meanings commonly understood by those of ordinary skill in the art to which the present invention belongs.

Before describing the present invention in detail, it is to be understood that this invention is not limited to particular devices or systems, which can, of course, vary. It is also to be understood that the terminology used herein is for the purpose of describing particular embodiments only, and is not intended to be limiting. As used in this specification and the appended claims, the singular forms "a", "an" and "the" include plural referents unless the content clearly dictates otherwise. Thus, for example, reference to "a component" can include a combination of two or more components, and the like.

Although many methods and materials similar, modified, or equivalent to those described herein can be used in the practice of the present invention without undue experimentation, the preferred materials and methods are described herein. In describing and claiming the present invention, the following terminology will be used in accordance with the definitions set out below.

As used herein, the term "slider shaft" means a shaft on which one or more link sliders and/or a lock slider can be slidably mounted. A slider shaft can have any functional cross-section of any shape, e.g., round, oval, I-beam, triangular, polygonal, U-channel, etc.

The term "link slider", as used herein, refers to a component of the present locking devices adapted to slidably mount to a slide mount frame, e.g., on a slide shaft or slider slit, and which can form a link between at least two other device components. For example, a link slider can function to lock or release between two other link sliders, between an anchor tab and another link slider, between an anchor tab and a lock slider, or between another link slider and a lock slider. A link slider can be securely linked to adjacent components in series on a slide mount, e.g., with a shackle inserted into aligned bores through tabs of the link slider and adjacent components.

The term "lock slider", as used herein, refers to a component of the present locking devices adapted to slidably mount to a slide mount frame and comprising a lock bolt.

The term "lock bolt", as used herein, refers to an extension from a lock slider that can be moved to functionally secure the locking device in a "locked" condition. The locked condition can depend on the configuration of the locking device. For example, in embodiments using a chain to secure a gate, at least one link of the security chain is captured by the lock bolt when the device is in a locked condition. In many embodiments, the lock bolt functions essentially as other lock bolts in the art, e.g., by insertion into a receiver recess thereby interfering with the opening of a door when in the locked position.

The term "receiver recess", as used herein, refers to, e.g., a recess which can receive all or part of a lock bolt when the locking device is in a locked configuration. Depending on the device configuration a receiver recess can be located in a slide mount frame, in a door (e.g., receiving a bolt extending from the door frame) or in door frame (e.g., receiving a bolt extending from the door).

BRIEF DESCRIPTION OF THE DRAWINGS

In FIG. 1A, a chain link is captured and the device is locked. In FIG. 1B, one of two shackles is removed allowing the lock slider to be moved to an unlocked position so the chain can be released.

In FIG. 2A, all shackles are in place and the latch is locked with the lock bolt held in receiver recesses. In FIG. 2B, one shackle has been removed and the lock bolt is free to be removed from the receiving recesses, thus unlocking the device. FIG. 2C is a cross section through the device at a link slider showing three housing walls and double slide shafts. FIG. 2D is a cross section through the latch mechanism showing the locking bolt set in two receiver recesses.

FIG. 3A shows the locking device in a locked configuration with the lock bolt inserted into a latch receiver recess, e.g., mounted to a door frame (with the front housing wall removed to view internal mechanism with better clarity). FIG. 3B shows a cross section through the device at a link slider. In FIG. 3C, one shackle has been removed and the lock bolt is allowed to be retracted from the receiver recess.

DETAILED DESCRIPTION

The present invention provides locking devices with lock sliders having lock bolts releasable alternately by removal of any one of several shackles (e.g., padlocks) from the device. In many embodiments, an anchor tab on a lock frame is securely linked to a lock slider through a series of slider links, which are interconnected using several padlocks to render the lock shaft and lock bolt immobile. Removal on any one padlock can break the connection between the lock shaft and anchor tab, allowing the lock bolt to be moved, e.g., from a locking position to a disengaged (unlocked) position. Such a device can allow, e.g., a locked gate or door to be opened by a holder of a key to any one of the several padlocks. Slider links of the invention are typically slidably mounted to the lock frame, e.g., within a housing and/or on a slide shaft.

The Locking Devices in General

The invention typically provides security with alternate access permission controlled by locking devices well adapted to control entry through gates. The locking devices optionally include a housing aspect of the lock frame, e.g., to provide frame strength and protect the shackles from weather and attack. The locking devices are optionally configured to functionally interact with security chains, e.g., to secure common gates without substantial modification to the gate itself.

Locking devices of the invention generally include a slide mount frame with an anchor tab and slidable mounting means for one or more link sliders and a lock slider comprising a lock bolt. The lock slider and bolt can be made substantially (functionally) immobile by connecting the anchor to the link slider and the link slider to the lock slider with shackles (configuration allowing access by two users—see FIG. 1). Optionally, the locking device can include two or more link sliders between the anchor and lock slider, to allow for three or more users. Typically, the lock bolt is inserted into a receiver recess before it is immobilized, thus, e.g., securely latching the gate or capturing a security chain. In some embodiments, the lock bolt can be immobilized outside of the receiver recess, e.g., to prevent closure of the entryway, thus ensuring egress and/or providing safety in a hazardous environment.

A Chain Capture Design

Figure 1A:
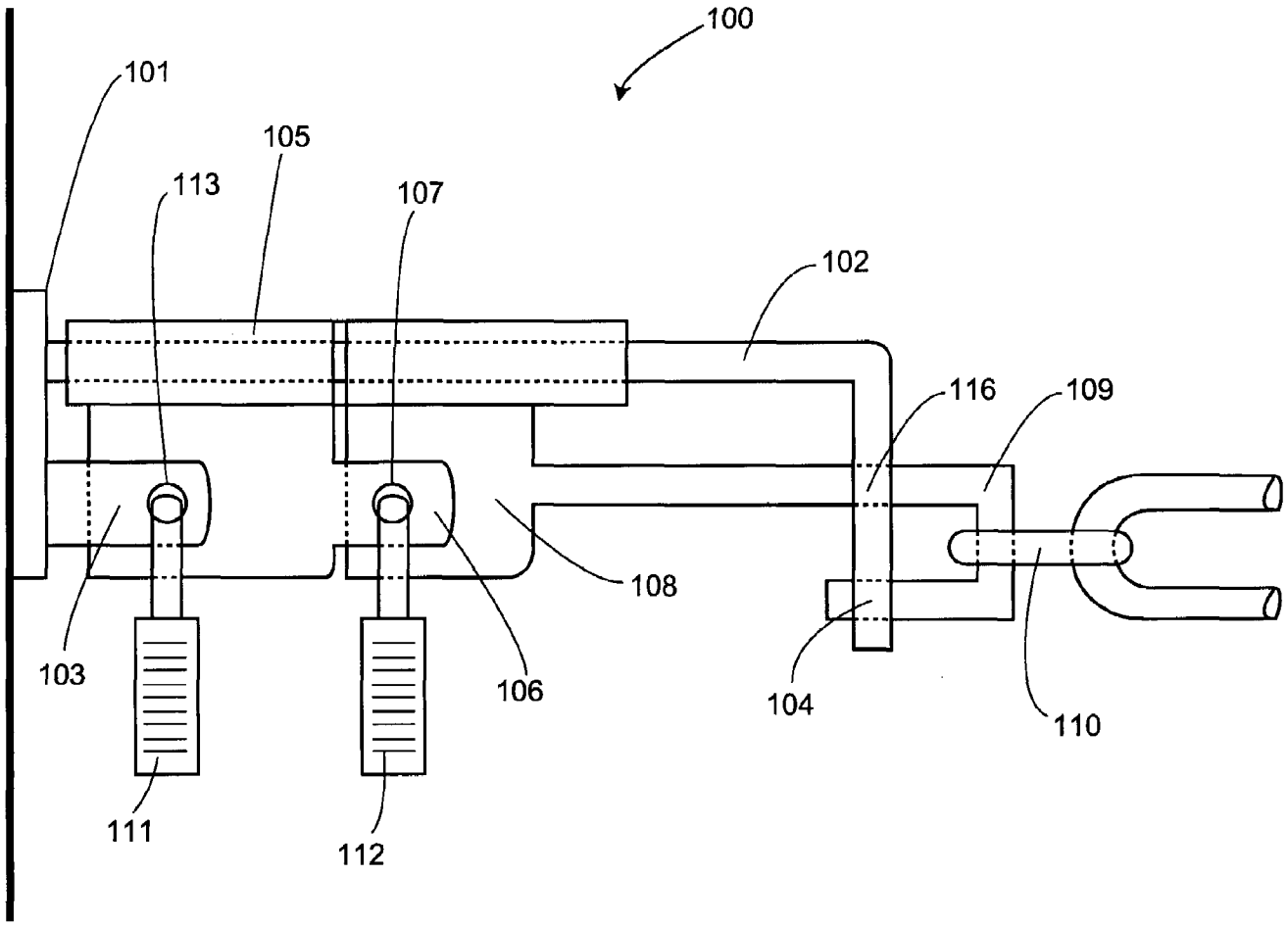
FIGS. 1A and 1B are schematic diagrams of a multiple access locking device wherein a slide shaft also acts as a main slide mount frame structural member.

In a preferred embodiment, shown in FIG. 1, locking device 100 includes slide mount frame 101 with a slide shaft 102, anchor tab 103 and receiver recess 104. A link slider 105 is slidably mounted to the slide shaft and includes a link tab 106 with link tab bore 107. Also slidably mounted to the slide shaft 102 is lock slider 108 with lock bolt 109. In locked configuration, as shown in FIG. 1A, a chain link 110 is captured by lock bolt 109. The chain link can not be released because the lock bolt is rendered essentially immobile by: 1) first padlock 111 locking anchor tab 103 to link slider 105 by shackling through both the slider link bore and anchor tab bore 113; and, 2) second padlock 112 locking slider link tab 106 to lock slider 108 by shackling through both the slider link tab bore 107 and lock bore 115.

Figure 1B:
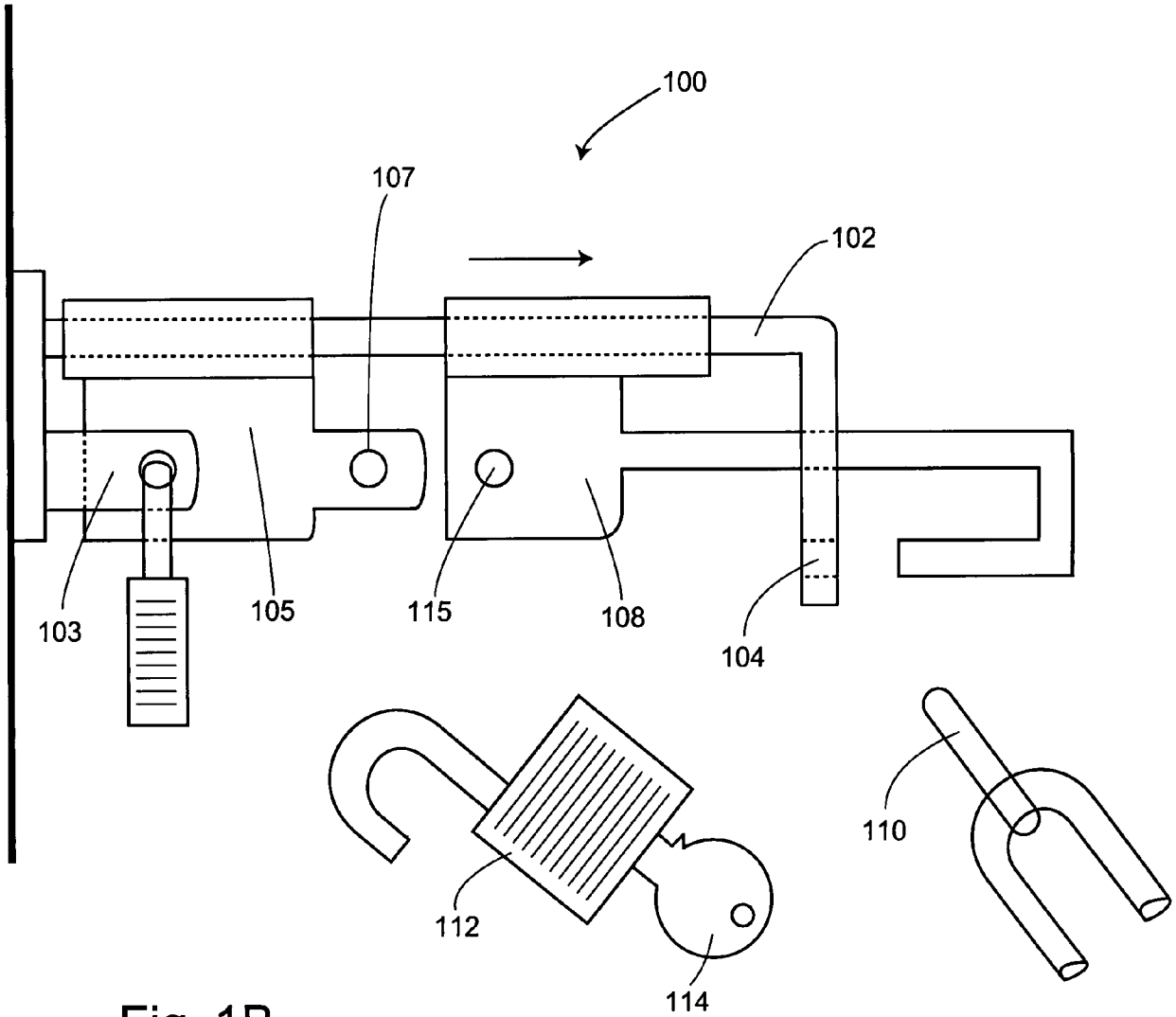

Removal of any one of the two padlocks can release the chain link, as shown in FIG. 1B. A user with possession of second key 114 can slide the shackle of second padlock 112 out of slider link tab bore 107 and lock bore 115. With the shackle removed, lock slider 108 is free to slide along slide shaft 102 in a direction that can remove the lock bolt 109 from the receiver recess 104, thus freeing the chain link 110.

Such a locking device can secure a gate, e.g., if it is mounted to a gate post and receives a chain or link securely mounted to the gate. Alternately, one end of a security chain can be mounted (e.g., welded) to the locking device frame, the chain routed around the gate post (e.g., end fence post) and through the gate frame, and the other end of the chain captured by the lock bolt to lock the gate. Alternately, the locking device can secure a gate, e.g., by capturing both ends of a security chain that has functionally been passed around a gate post and through a gate frame.

A Latch Capture Design

In a more preferred embodiment, shown in FIG. 2, locking device 200 includes lock frame housing 201 (shown with the front wall removed for a clearer view of the mechanism) with a slide shaft 202, and anchor tab 203. Receiver recesses 204 are incorporated into latch 216. A first link slider 205 and second link slider 217 are slidably mounted to the slide shaft and includes a link tab 206 with link tab bore 207. Also slidably mounted to the slide shaft 202 is lock slider 208 with lock bolt 209. In a locked configuration, as shown in FIG. 2A, the lock bolt 209 is inserted into two receiver recesses 204, thus locking the lock frame to the latch. The lock bolt can not be removed from the latch receiver recesses because the lock bolt is rendered essentially immobile by three padlocks with: 1) first padlock 211 locking anchor tab 203 to link slider 205 by shackling through both the first slider link bore and anchor tab bore 213; 2) second padlock 212 locking first slider link tab 206 to second slider link 217 by shackling through both the first slider link tab bore 207 and second slider link bore; and, 3) third padlock 219 locking second slider link tab 220 to lock slider 208 by shackling through both the second slider link tab bore 221 and lock bore 215. Optionally, locking control by additional padlocks can be provided by adding additional link sliders in the series between the anchor tab and lock slider.

Figure 2A:
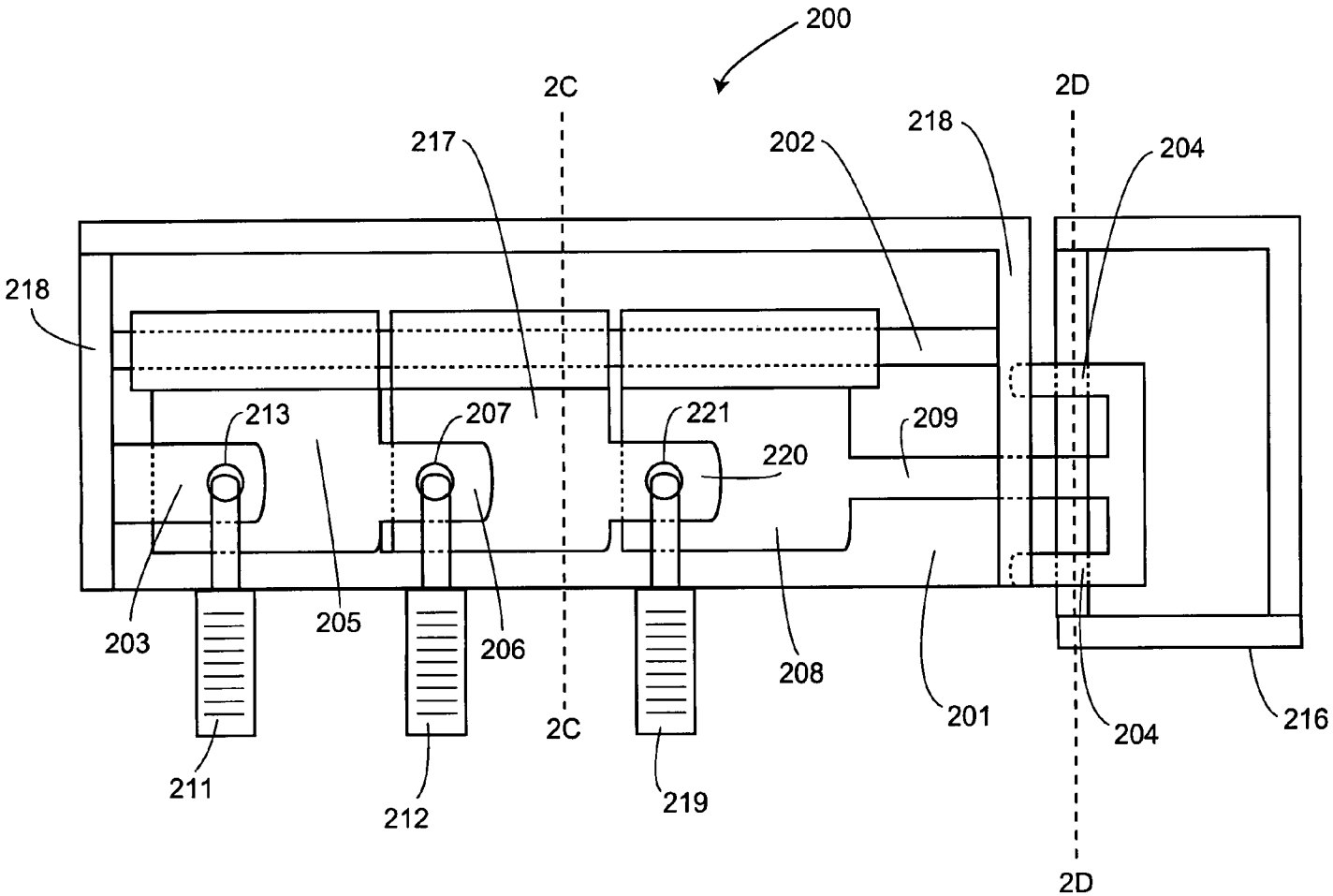
FIGS. 2A-2D are schematic diagrams showing a docking device with a housing and with slide shafts housed in the frame. Three shackles are each controlling a lockable latch.
Figure 2B:
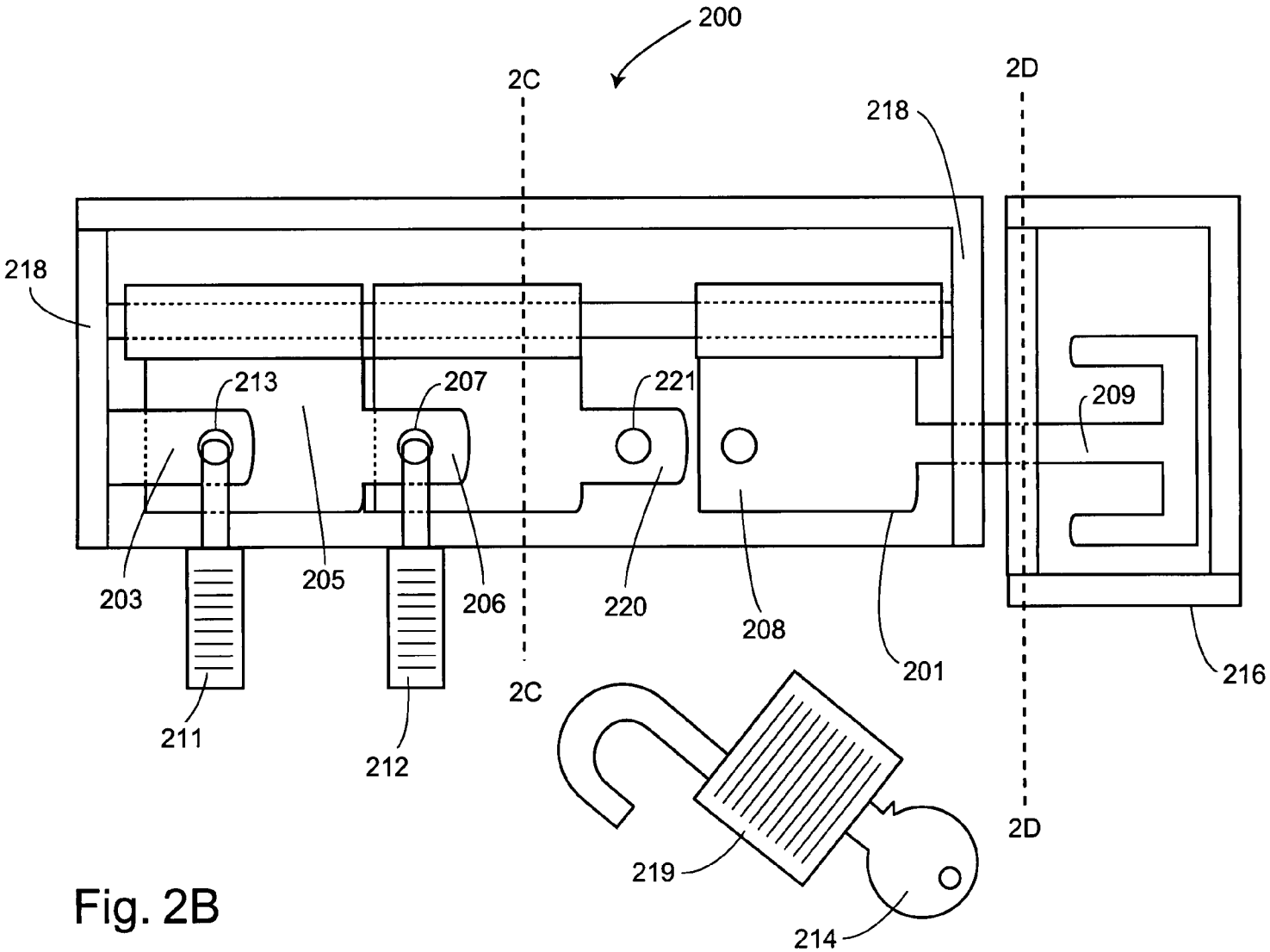
Figure 2D:
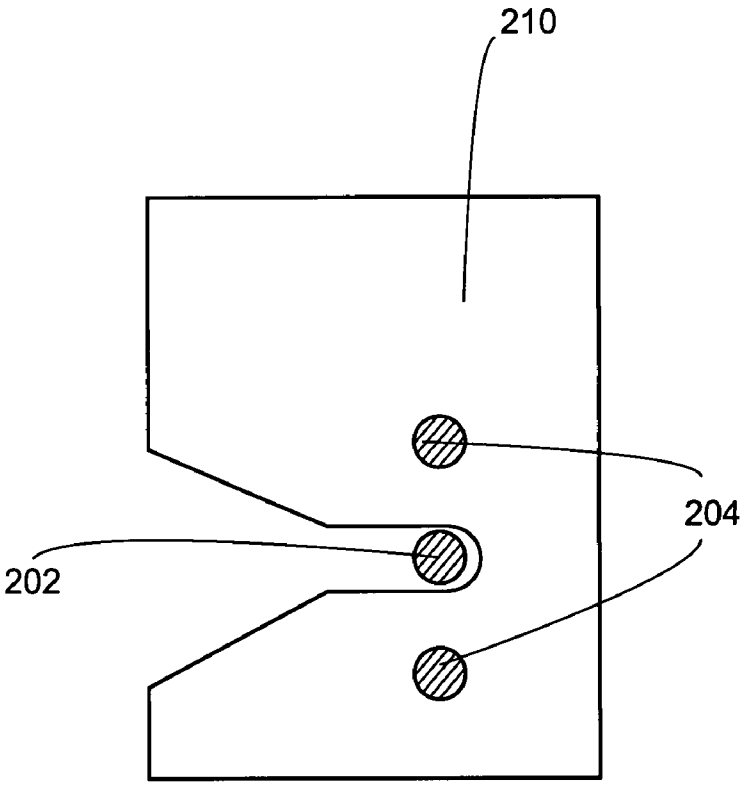

Removal of any one of the three padlocks can release the lock bolt from the latch, as shown in FIG. 2B. A user with possession of third key 222 can slide the shackle of third padlock 219 out of slider link tab bore 221 and lock bore 215. With the shackle removed, lock slider 208 is free to slide along slide shaft 202 in a direction that can remove the lock bolt 202 from the receiver recesses 204, thus freeing the bolt from the latch 216. With the lock housing mounted to the gate (e.g., by welding or bolting the housing wall to the gate frame) and the latch mounted to the gate post, the gate can be locked closed with the bolt in the recesses and the three padlocks in place.

A Direct Latch Design with a Slit Slide Mount

Figure 3B:
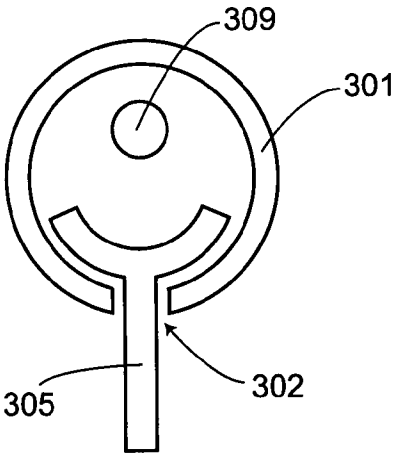
FIGS. 3A-3C are schematic diagrams of an inventive device wherein the slide mount is a slit in a cylindrical frame housing.
Figure 3A:
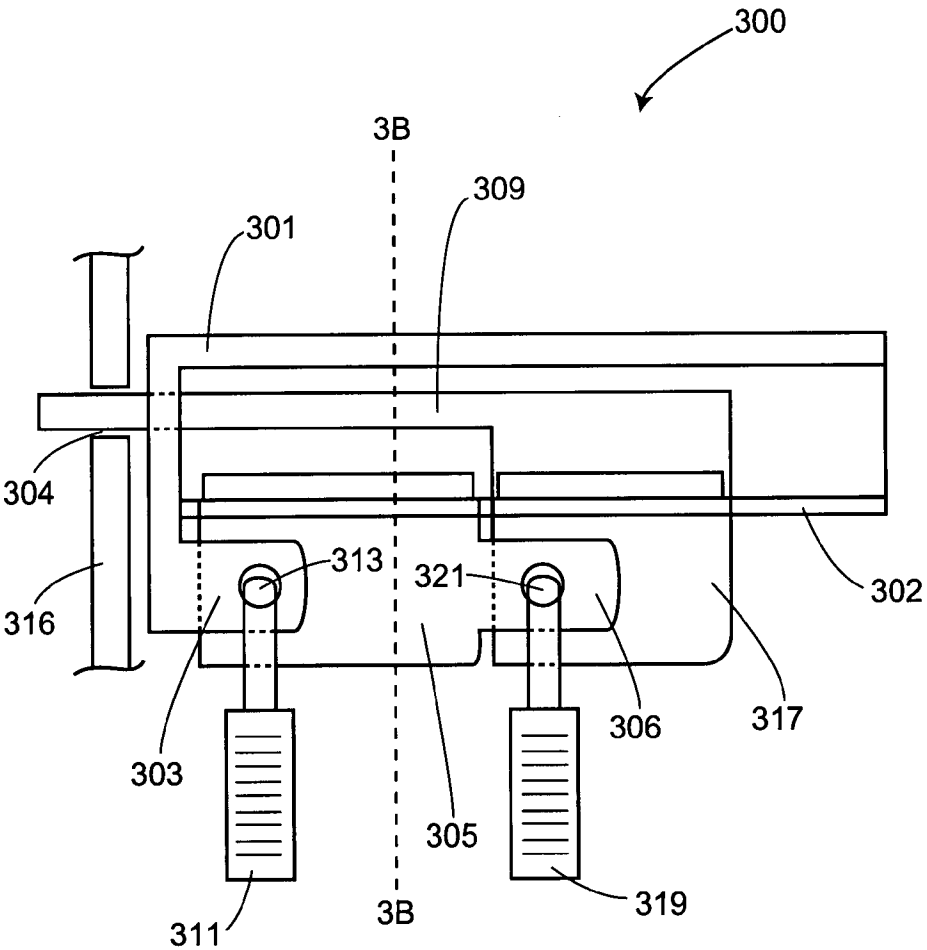

In another preferred embodiment of the invention, the slidable mount comprises a housing with a slit. As shown in FIG. 3, locking device 300 includes lock frame housing 301 with a slide slit 302, and anchor tab 303. Receiver recess 304 is incorporated into latch 316. A link slider 305 is slidably mounted within the lock frame housing 301 with the link tab 306 and the link bore extending out of the housing through the slide slit 302. Also slidably mounted to the lock frame housing 301 is lock slider 317 with lock bolt 309. In locked configuration, as shown in FIG. 3A, the lock bolt 309 is inserted into receiver recess 304, thus locking the lock frame to the latch. The lock bolt can not be removed from the latch receiver recess because the lock bolt is rendered essentially immobile by two padlocks with: 1) first padlock 311 locking anchor tab 303 to link slider 305 by shackling through both the slider link bore and anchor tab bore 313; and, 2) second padlock 319 locking slider link tab 306 to lock slider 317 by shackling through both the slider link tab bore 321 and lock bore 315.

Removal of any one of the two padlocks can allow the bolt to be released from the latch recess, as shown in FIG. 1B. A user with possession of second key 314 can slide the shackle of second padlock 319 out of slider link tab bore 321 and lock bore 315. With the shackle removed, lock slider 317 is free to slide along slide slit 302 in a direction that can remove the lock bolt 309 from the receiver recess 304.

Materials and Dimensions

The locking devices of the present invention are typically made from materials in dimensions providing high strength. Typically, the devices are designed to be at least somewhat stronger than the doors, gates or fences to be protected. In preferred embodiments, the devices are manufactured from a metal, such as, e.g., iron, steel, titanium, aluminum, brass and/or the like. Harder materials are desirable in components, such as the lock bolt that might be subject to attack by saws or bolt cutters. More ductile materials can be desirable in components, such as frame housings that might be subject to attack by hammers.

In preferred embodiments, the sheet or tubular components of the devices are made of steel at least ⅛", 5/16", ¼", ⅜" or more in thickness. For square or round stock components, such as shafts and bolts, diameters of at least 5/16", ¼", ⅜", ½", ⅝" or more are preferred.

Slide Mount Frames

Slide mount frames of the present locking devices can be provided in various configurations providing many benefits not provided in the prior art. A basic slide mount frame can include, e.g., a means to slidably mount link sliders and a lock slider. The slide mount frame can include a securely mounted anchor tab. The mount frame can optionally include a housing and/or a means to mount the frame.

Frame Function

Slide mount frames function to provide, e.g., strong mounting locations for anchor tabs, mounting for slide shafts, locations for bolt support holes, and/or locations for receiver recesses. The mount frames can provide an openable link in a security chain. In many cases, the mount frames can themselves be adapted for mounting to a stationary structure, such as a gate post or to a movable structure, such as a gate. Alternately, the mount frames can be independent of gate or fence, e.g., movably linked in a security chain loop.

In a preferred embodiment, the mount frame includes a housing. A mount frame housing can include a walled structure that surrounds the slider mounting means on at least 2 sides. For example, the housing can be a length of angle iron or half a cylinder that at least partly surrounds the slide mechanism (e.g., a slide shaft and part of a slider mounted to the shaft) of the lock system. The walls of the housing can add strength to the frame and can be a location for mounting fixtures, such as, e.g., holes for mounting bolts to hold the frame on a gate post or gate frame. In a more preferred embodiment, the housing surrounds the slide mechanism on at least three sides. For example, the housing can be a length of channel iron or ¾ of a cylinder that mostly surrounds the slide mechanism (see cross section of housing 201 in FIG. 2C and FIG. 4). In still other embodiments, the housing can be, e.g., a box or cylinder closed on the ends and open only on one side. The closed ends (e.g., end walls 218 of FIG. 2A) can strengthen the overall housing and frame structure while providing locations for shaft mounts, anchor mounts, recesses and/or bolt supports.

In one aspect of the invention, a housing of a slide mount frame can provide a slide slit, which can function as a component of a slide mechanism. For example, as shown in the transverse section of a locking device in FIG. 4A, a housing 400 can act as a frame component and as a slide mount, e.g., slide slit 401, that slidably receives a slider 402 with a tab 403 extending out through the slit.

In another aspect of frame housings, the housing walls can provide protection for components against weather and attack by intruders. Housing walls can be designed and mounted so that there is a cover (roof) over the other components of the device. This can prevent rain, grit and the sun from damaging the components. For example, a locking device with three side walls surrounding the sliders can be mounted so that the open $4^{th}$ side is facing down or out (horizontally), so that at least one wall is covering the components. In a similar fashion, the walls of the housing can substantially enhance the security of the device by blocking access to tools an intruder might use to break the lock system. For example, by covering the mechanism on two or more sides, many tools, such as torches, hack saws, hammers, pry bars, and the like, can not be used effectively to attack components of the device, Slide Mounts Slide mounts can be any type of sliding mount means known in the art, such as, e.g., a slide shaft, multiple slide shafts, a slit that guides a tab, rail systems, cable systems, and/or the like. In certain embodiments, the slide mount is not also the lock bolt of the device.

Figure 2C:
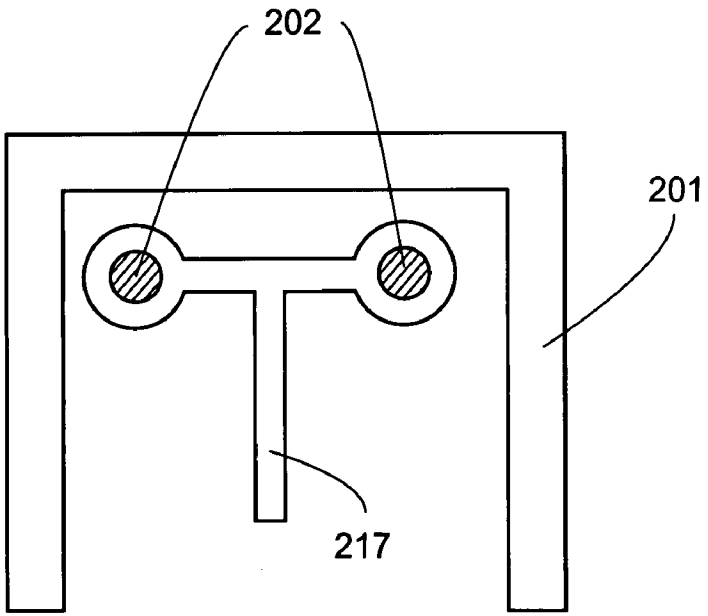

As shown in FIG. 1, the slide mount can be a slide shaft adapted to functionally receive sliders. As shown in FIG. 2C, the slide mount can include two or more slide shafts. The slide mount can optionally act as a structural part of the slide lock frame. As shown in FIG. 1, the slide shaft can provide the strength and structure for the mount frame running from the anchor tab to the receiver recess and or lock bolt support 116.

Figure 4B:
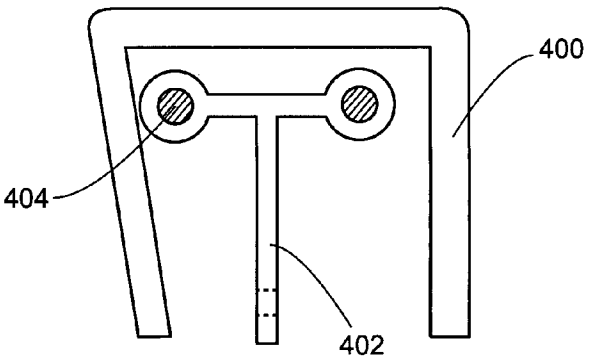
FIGS. 4A-4D show cross sections through link sliders in representative devices having frame housings.
Figure 4D:
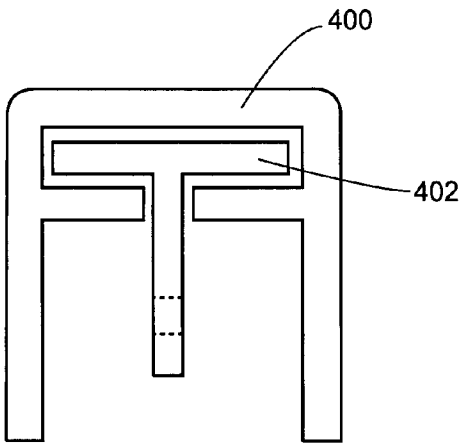
Figure 4A:
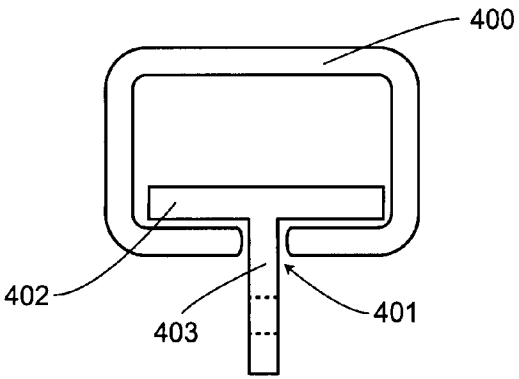
Figure 4C:
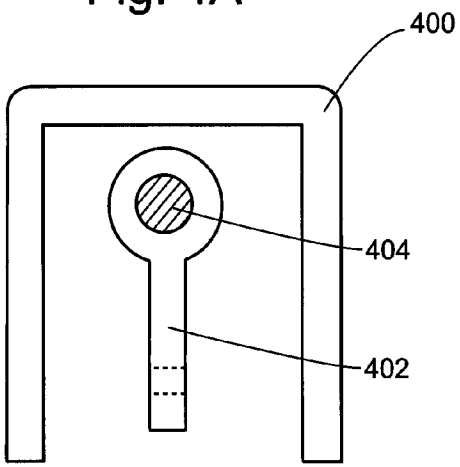

In a preferred embodiment of the invention, as shown in transverse section FIGS. 4B and 4C, one or more slide shafts 404 can play a role in the slidable mounting of sliders 402 while all or part of the frame structural function is carried out by a frame member, such as a frame housing 400.

In another preferred embodiment, the slide mount includes a slide slit, as discussed above. For example, the main body of link sliders and/or the lock slider can retained (e.g., too large to fit through the slit) within a housing that is closed on all four sides, but for a slide slit. The sliders can have a tab that extends from the slit. The tab can be manipulated to slide the slider along the slit. The part of the slider tab extending out from the slit can have one or more bores, accessible to shackles and capable or alignment with bores of other sliders of the device; for example, see FIGS. 3B, 4A and 4D.

Slide mount components can also act as structural members of the frame, as discussed above. For example, slide shafts and/or housings can each function, together or separately as slide mounts and/or structural frame members. In a preferred embodiment, as shown, e.g., in FIG. 2, the device includes a box frame housing open on only one side; one or more slide shafts are mounted between the housing end walls, thus forming a highly secure and strong slide mount frame. In some embodiments, the housing can be oriented so that the shackles are accessible from either side of the secured entryway.

Link Sliders

Link sliders of the locking devices are adapted to functionally interact with the slide mounts and to provide appropriate locking alignments among the various anchor, link and lock bores to receive shackles.

Link sliders are typically made up of one or more tabs and a link body. The link body generally interacts with a slide mount mechanism of the slide mount frame so the link slider can move functionally along the slide mount without being removable from the device in normal use. The link tabs typically extend from the link body away from the slide mount to a position where bore alignments can take place and shackles can be conveniently inserted through properly aligned bores by users.

Link slider bodies on slide shafts are generally tubular members with internal dimensions that are just larger than the outer dimensions of the associated slide shaft. Typically the shafts are solid cylindrical rods and the slider bodies are hollow cylinders with an axial bore. In embodiments where the slide mount is a slit, the slider bodies can be any shape adapted to function by, e.g., preventing the slider from falling out of the slit, sliding freely, and optionally serving to properly space the slider from other sliders in the device.

Link slider tabs typically extend from the slider bodies and slide mount to provide overlapping alignment of component bores and access to bores by shackles. Link slider tabs can have a single (e.g., oblong) link bore that can extend along the tab far enough, e.g., to align with both the bore of an anchor tab and a bore of another link slider (or lock slider). In a preferred embodiment, slider tabs have two bores: one link bore that aligns with an anchor bore or another link bore on one side (e.g., front or rear section along the sliding axis) of the link slider, and a second link bore that aligns with the bore of another link slider or a lock bore of a lock slider (e.g., as shown in the figures). The alignment of bores is typically accomplished by the tabs of the slider extending in the direction of slide motion beyond the reach of the slider body in that direction. For example, a first slider tab can extend to one side so that it overlaps the tab of a subsequent slider. Bores of the first tab and subsequent tabs can align when the bodies of the sliders are immediately adjacent. In regions where the tabs of adjacent sliders overlap, the tabs of one or both can be offset (e.g., bent) slightly aside so they do not conflict as they slide adjacent past each other. Tabs can extend in the sliding axis from one or both sides of a slider to overlay an adjacent tab and align bores. In many embodiments, tabs of each slider extend on one side to reach the bore on a non-extended part of the adjacent tab, as shown, e.g., in FIG. 2A. Optionally, link sliders can have tab extensions extending to tabs of other components on both sides of the link slider.

Locking devices of the invention can include one or more link sliders. For example, the locking devices can have 1 link slider, 2 link sliders, 3 or more link sliders, 5 or more link sliders, or 10 or more link sliders. The number of shackles, each able to unlock the device, is generally one more than the number of link sliders. It is appreciated that the locking device can be designed to allow the number of link sliders to be changed, e.g., by inserting or removing sliders and, e.g., changing the length of the lock bolt.

Lock Sliders and Receiver Recesses

Lock sliders can be designed with significant similarities to the link sliders of the same device. For example, lock sliders can have lock slider bodies adapted to functionally interact with the slide mounts, as described above for link sliders. Lock sliders can have a lock tab extending from the lock slider body with a bore functionally alignable with the link bore of an adjacent link slider. However, the lock slider additionally has a lock bolt that can be configured, e.g., to interact with receiving recesses, in a variety of ways to provide the locking function of the device.

Figure 3C:
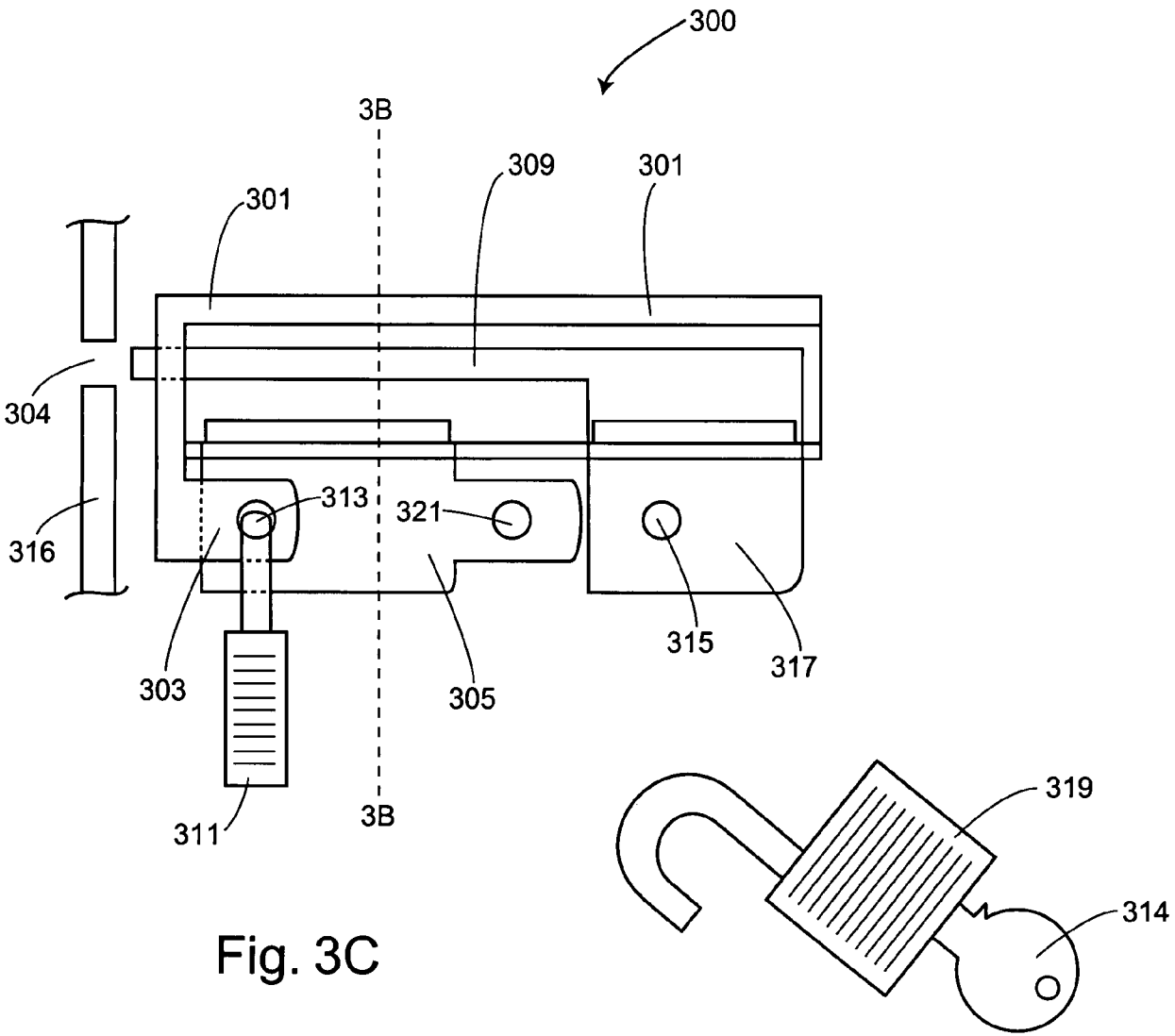

Lock sliders can be held in a first locked position by the anchor tab of the frame when the lock slider is securely connected (e.g., with shackles through aligned bores, as described above) to the anchor tab through one or more link sliders. When the secure connection is broken, e.g., by removal of any one of the required shackles, the lock slider can slide into an unoccupied position on the slide mount. This sliding motion can relocate the lock bolt to unlock the locking device. The sliding of the lock slider to an unlocked position can result in the lock bolt being extended from the mount frame (e.g., as shown in FIGS. 1B and 2B) and/or result in the lock bolt being withdrawn toward the mount frame (e.g., as shown in FIG. 3C).

Although it is optional in many embodiments, it is often desirable to have the lock bolt received into a receiver recess when in the locked position. There is substantial strength in the cantilever extension of the lock bolt, e.g., out from lock bolt support (e.g., slide bushing) in the wall of a mount frame. However, the lock bolt can be further substantially strengthened, against bending from attack by pry bars and such, when the end of the bolt is received into a recess, as shown, e.g., in FIGS. 1A, 2A and 2D.

It is understood that the examples and embodiments described herein are for illustrative purposes only and that various modifications or changes in light thereof will be suggested to persons skilled in the art and are to be included within the spirit and purview of this application and scope of the appended claims.

While the foregoing invention has been described in some detail for purposes of clarity and understanding, it will be clear to one skilled in the art from a reading of this disclosure that various changes in form and detail can be made without departing from the true scope of the invention. For example, the locking devices described can be adapted with various combinations of components, having various configurations, to secure various styles of gates, doors, and containers.

All publications, patents, patent applications, and/or other documents cited in this application are incorporated by reference in their entirety for all purposes to the same extent as if each individual publication, patent, patent application, and/or other document were individually indicated to be incorporated by reference for all purposes.

What is claimed is:

1. A locking device comprising:

a slide mount frame comprising a housing, one or more slide shafts, a receiver recess, an anchor tab with an anchor bore;

one or more link sliders slidably mounted along the one or more slider shafts and each comprising a link tab with one or more link bores; and, a lock slider slidably mounted to the one or more slide shafts and comprising a lock bolt and comprising a lock tab with a lock bore;

wherein the anchor bore can be aligned with a first of the one or more link bores of a first link slider, allowing passage of a first shackle into the aligned bores; and, wherein the lock bore can be aligned with the first link bore, a second of the one or more link bores of the first link slider or with a bore of a second of the one or more link sliders, allowing passage of a second shackle into the aligned bores;

whereby the lock bolt is received by the recess when both the anchor bore and lock bore are thus aligned.

2. The locking device of claim 1, wherein the housing, link sliders or lock slider comprise steel.

3. The locking device of claim 1, further comprising a freedom of movement of the link sliders or lock slider comprising at least 0.25 inches along a slide axis.

4. The locking device of claim 1, wherein the first shackle or second shackle comprises a padlock.

5. The locking device of claim 1, further comprising a chain with a first link that can be captured by the lock bolt before the lock bolt is received by the recess when both the anchor bore and lock bore are aligned with the link bores.

6. The locking device of claim 5, wherein a second link of the chain is mounted to the housing or mounted to a gate.

7. The locking device of claim 1, wherein the lock bolt can not be removed from the receiver when the shackles are passed into the aligned bores.

8. The locking device of claim 1, wherein the lock bolt is not a slide shaft with mounted link sliders.

9. The locking device of claim 1, wherein there are two or more link sliders lockable in series between the anchor tab and lock slider.

10. A locking device comprising:

a slide mount frame comprising a housing and an anchor tab with an anchor bore;

one or more link sliders slidably housed in the housing with each link slider comprising a link tab with one or more link bores; and, a lock slider slidably housed in the housing and comprising a lock bolt and comprising a lock tab with a lock bore;

wherein the anchor bore can be aligned with a first of the one or more link bores allowing passage of a first shackle into both the anchor bore and the first link bore; and, wherein the lock bore can be aligned with a bore selected from the group consisting of the first link bore, a second of the one or more link bores and a bore of a second of the one or more link sliders; allowing passage of a second shackle into the lock bore and the selected bore.

11. The locking device of claim 10, wherein the link sliders are not slidably mounted to a slide shaft.

12. The locking device of claim 10, wherein the link tabs extend outside of the housing through a slit.

13. The locking device of claim 10, further comprising a receiver recess mounted to the housing or mounted to a gate.

14. The locking device of claim 10, wherein if there are two or more link sliders slidably mounted in series, then each link has bores that can be aligned to bores of adjacent components so that insertion of a shackle into the aligned bores locks the anchor bore to the lock slider.

15. A locking device comprising:

a slide mount frame comprising a receiver recess and comprising an anchor tab with an anchor bore;

one or more link sliders slidably mounted to the slide mount with each link slider comprising a link tab with one or more link bores;

a lock slider slidably mounted to the slide mount and comprising a lock bolt and comprising a lock tab with a lock bore; and, a chain comprising one or more links that can be captured by the lock bolt when the lock bolt is received by the receiver recess;

wherein the anchor bore can be aligned with a first of the one or more link bores allowing passage of a first shackle; and, wherein the lock bore can be aligned with the first link bore, a second of the one or more link bores or to a bore of a second of the one or more slider links, allowing passage of a second shackle;

whereby the lock bolt is received by the recess when both the anchor bore and lock bore are thus aligned; thereby capturing a link of a chain when the lock bolt is received by the receiver.

16. The locking device of claim 15, wherein the slide mount frame comprises a housing or a slide shaft.

17. A locking device comprising:

a slide mount frame comprising a housing comprising a slide slit, an anchor tab with an anchor bore;

one or more link sliders each comprising a link tab with one or more link bores and slidably housed in the housing with the link tabs protruding from the housing through the slide slit; and, a lock slider comprising a lock bolt and comprising a lock tab with a lock bore, the lock slider slidably housed in the housing with the lock tab protruding from the housing through the slide slit;

wherein the anchor bore can be aligned with a first of the one or more link bores allowing passage of a first shackle into both the anchor bore and the first link bore; and, wherein the lock bore can be aligned with a bore selected from the group consisting of: the first link bore, a second of the one or more link bores and a bore of a second of the one or more link sliders; allowing passage of a second shackle into the lock bore and the selected bore.

18. The locking device of claim 17, wherein the link sliders are not slidably mounted to a slide shaft.

19. The locking device of claim 17, further comprising a receiver recess mounted to the housing or mounted to a gate, wherein the receiver recess is positioned to receive the lock bolt.

* * * * *